US006711867B1

(12) United States Patent
Smith

(10) Patent No.: US 6,711,867 B1
(45) **Date of Patent: *Mar. 30, 2004**

(54) SELF-JIGGING RESILIENT CONSTRUCTION MEMBER AND RETROFIT SYSTEM USING SAME

(75) Inventor: Mark Howard Smith, Newark, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/338,892

(22) Filed: Jun. 23, 1999

Related U.S. Application Data

(63) Continuation-in-part of application No. 09/209,308, filed on Dec. 11, 1998.

(51) Int. Cl.[7] ..... E04C 3/30

(52) U.S. Cl. ..... 52/696; 52/731.5; 52/729.4; 52/737.3; 52/481.1

(58) Field of Search ..... 52/696, 731.5, 52/729.4, 737.3, 481.1, 481.2

(56) References Cited

U.S. PATENT DOCUMENTS

| | | | | | |
|---|---|---|---|---|---|
| 16,183 | A | | 12/1856 | Burrell | |
| 1,204,956 | A | | 11/1916 | Day | |
| 1,649,226 | A | * | 11/1927 | Gstalder | 52/481.1 |
| 1,729,741 | A | * | 10/1929 | Heltzel | |
| 1,732,348 | A | | 10/1929 | Balduf | |
| 1,754,942 | A | * | 4/1930 | Goldsmith | 52/481.1 |
| 1,894,933 | A | | 1/1933 | Venzie | |
| 2,026,117 | A | | 12/1935 | Balduf | |
| 2,081,765 | A | | 5/1937 | Prudden | |
| 2,154,944 | A | * | 4/1939 | Kullmer | 52/481.1 |
| 2,565,875 | A | | 8/1951 | Musacchia | |
| 2,710,335 | A | | 6/1955 | Wong | |
| 3,046,620 | A | | 7/1962 | Tvorik et al. | |
| 3,324,615 | A | | 6/1967 | Zinn | |
| 3,349,535 | A | | 10/1967 | Balinski | |
| 3,445,975 | A | | 5/1969 | Nelsson | |
| 3,609,933 | A | * | 10/1971 | Jahn et al. | 52/461 |
| 3,712,846 | A | | 1/1973 | Daniels et al. | |
| 3,721,050 | A | | 3/1973 | Perina | |
| 3,999,343 | A | | 12/1976 | Roberts | |
| 4,207,719 | A | | 6/1980 | Knowles | |
| 4,308,703 | A | * | 1/1982 | Knowles | 52/694 |
| 4,317,503 | A | * | 3/1982 | Soderquist et al. | 181/290 |
| 4,337,287 | A | | 6/1982 | Falkenberg | |
| 4,466,225 | A | * | 8/1984 | Hovind | 52/730 |

(List continued on next page.)

FOREIGN PATENT DOCUMENTS

| | | | | |
|---|---|---|---|---|
| CA | 1122377 | | 4/1982 | |
| CH | 552 110 | | 7/1974 | |
| DE | 1 814 435 | | 6/1970 | |
| DE | 1 784 729 | | 8/1971 | |
| EP | 0 136 618 | * | 4/1985 | |
| FR | 2575243 | | 6/1986 | |
| JP | 9-268677 | * | 9/1997 | 52/238.1 |
| JP | 10-2049 | * | 10/1998 | 52/238.1 |

*Primary Examiner*—Carl D. Friedman
*Assistant Examiner*—Dennis L. Dorsey
(74) *Attorney, Agent, or Firm*—Inger H. Eckert; Stephen W. Barns; Maria C. Gasaway

(57) ABSTRACT

A construction beam includes a pair of lateral members and a resilient web extending therebetween, so as to present a cross-sectional profile corresponding to commonly used construction beam members (e.g., 2"×4" or 2"×6"). The resilience of the web helps to attenuate sound transmission through the beam from one lateral member to the other. In particular, in a wall frame, the lateral members are mounted at opposite ends thereof to end plates consisting of other construction beams according to the present invention (i.e., a pair of lateral members with resilient web extending therebetween).

15 Claims, 7 Drawing Sheets

U.S. PATENT DOCUMENTS 4,523,419 A * 6/1985 Palacio et al. ..... 52/696
4,661,392 A 4/1987 Kapstad
4,794,746 A * 1/1989 Ramer ..... 52/695
4,862,667 A * 9/1989 Melland ..... 52/729
5,079,894 A 1/1992 Lau
5,094,052 A * 3/1992 Gudmundsson et al. ... 52/238.1
5,117,598 A 6/1992 Livingston et al.
5,146,721 A * 9/1992 Candiracci ..... 52/144
5,257,483 A * 11/1993 Netek ..... 52/23
5,272,284 A * 12/1993 Schmanski ..... 181/210
5,301,487 A 4/1994 Wiebe
5,361,556 A * 11/1994 Menchetti ..... 52/561
5,592,800 A * 1/1997 Koo et al. ..... 52/692
5,606,833 A 3/1997 Anderson
5,606,841 A 3/1997 Carter, Jr.
5,661,273 A 8/1997 Bergiadis
5,724,784 A * 3/1998 Menchetti ..... 52/483.1
5,740,644 A * 4/1998 Menchetti ..... 52/281
5,743,058 A * 4/1998 Boomsma ..... 52/481.2
5,749,192 A * 5/1998 Menchetti ..... 52/489.1
5,852,908 A 12/1998 Nankin
5,923,002 A 7/1999 McGrath et al.
5,996,303 A * 12/1999 Pellock ..... 52/693
6,007,890 A * 12/1999 DeBlander ..... 428/72
6,082,060 A * 7/2000 Bauer et al. ..... 52/173.3
6,266,936 B1 * 7/2001 Gelin ..... 52/481.1

* cited by examiner

SELF-JIGGING RESILIENT CONSTRUCTION MEMBER AND RETROFIT SYSTEM USING SAME

This application is a continuation-in-part of U.S. Ser. No. 09/209,308 entitled "Resilient Wall Stud" (filed on Dec. 11, 1998 and still pending), the entire application being incorporated herein by reference. This application is also related to U.S. Ser. No. 09/260,972 entitled "Sound Attenuating Structural Systems and Sound Attenuating Board Member Used Therefor" (filed on Mar. 2, 1999 and still pending), which application is a continuation-in-part of U.S. Ser. No. 09/209,308. The entire contents of U.S. Ser. No. 09/260,972 is also incorporated herein by reference.

TECHNICAL FIELD AND INDUSTRIAL APPLICABILITY OF THE INVENTION

The present invention relates to members used in construction, especially in applications where sound attenuation and sound isolation is important. In particular, the present invention relates to construction members used to construct building structures in which sound transmission from one room to another is to be prevented or reduced.The present invention also relates to a system for retrofitting a pre-existing standard wall frame with an improved stud construction which improves sound attenuation characteristics across the wall.

BACKGROUND OF THE INVENTION

Standard wall frame systems including a plurality of interconnected individual stud have long been used to construct walls. Also, in general, it is conventionally known to resiliently mount a wall or ceiling in order to isolate sound or attenuate transmission therethrough.

U.S. Pat. No. 3,445,975 to Nelsson discloses a partition in which first and second lath panels are held against a metallic stud, channel, or furring member by a clip fastener. One portion of the stud, channel, or furring member is cantilevered away from the portion at which the lath panels are clipped thereto. According to Nelsson, this permits the free portion of the stud, channel, or furring member to flex as the lath panels mechanically respond to sound waves incident thereon. The remainder of the structure dampens this surface movement, reducing sound transmission to the opposite surface of the partition.

U.S. Pat. No. 3,324,615 to Zinn discloses a construction member having a plurality of laterally extending supporting tabs by which wallboard segments are resiliently mounted.

U.S. Pat. No. 3,046,620 to Tvorik et al. discloses a ceiling hanger member whereby a furring strip (to which a ceiling member is attached) is resiliently attached to a joist, such that the weight of the furring strip and ceiling member resiliently separates the furring strip from the joist.

Another known method of sound attenuation is to build a wall frame in which individual studs are laterally staggered relative to a toe plate and head plate. Therefore, alternate studs are used to mount wall board on respective sides of the frame so that a given stud is spaced away from one of wall boards.

Unfortunately, the foregoing conventional methods of noise attenuation are problematic in that they generally move away from basic construction methods and thereby increase complexity and cost. For example, they require additional parts (such as Tvorik et al. and Nelsson) or specially made parts (such as the channel member with specially formed support tabs, as in Zinn). The staggered stud arrangement necessarily results in a thicker wall partition which reduces the area of the room whose walls are framed in this manner, and increases the cost of the toe and head plates.

In addition, nail fasteners generally cannot be used with metal members, thereby undesirably restricting available construction methods.

Finally, a standard wall frame system must generally be completely torn down to put a conventional sound attenuating systems into place. It would be therefore desirable to be able to retrofit a standard wall frame system so as to increase its sound attenuation characteristics.

In addition to the devices for sound attenuation described hereinabove, a wood I-beam is commercially available (e.g., under the brand name "BCI Advantage" from Boise Cascade Corporation) that comprises a pair of wood members with a rigid wooden panel extending therebetween. However, because the wooden panel is essentially non-resilient, this I-beam offers little or no sound attenuation benefit.

SUMMARY OF THE INVENTION

The present invention is therefore most generally directed to a construction member that relies on resilient flexibility in order to attenuate sound transmission therethrough, but also more closely conforms to conventional building members in order to minimize or eliminate the need for any special handling or the like in use.

In particular, the present invention is directed to a construction beam member which are comparable in size to conventional wood beams (e.g., 2"×4" or 2"×6"). The beam comprises a pair of spaced of lateral members having at least one resilient web extending therebetween. The web is preferably relatively stiff, but permits a slight flexure between the lateral members. The lateral members are preferably made from an easily workable material such as wood.

In addition, the web is preferably provided with one or more spacers so as to facilitate the arrangement of the respective lateral members relative to each other and relative to the web. In part, this facilitates the assembly of the lateral members relative to each other and to the lateral web so as to obtain a beam member according to the present invention.

In a particular embodiment of the present invention, a retrofit system comprising one lateral member having a resilient web attached thereto is provided. The resilient web is provided with one or more spacers so that the one lateral member having the resilient web attached thereto can be easily positioned relative to a respective beam in a standard wall frame construction, thereby imparting the sound attenuation benefits of a frame using resilient construction beams without needing to completely tear down the original structure. In this arrangement, respective beams in the standard wall frame act as the other lateral member of the beam according to the present invention.

BRIEF DESCRIPTION OF THE DRAWINGS

The present invention will be described in detail hereinbelow, with reference to the drawings appended herto, in which.

DETAILED DESCRIPTION AND PREFERRED EMBODIMENTS OF THE PRESENT INVENTION

Figure 1:
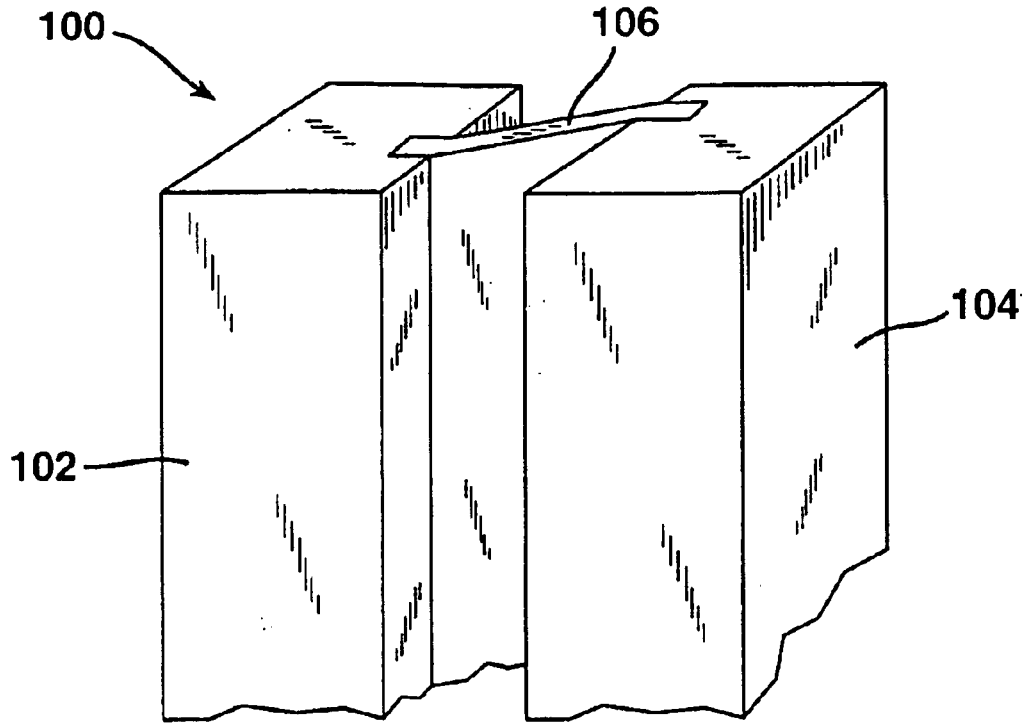
FIG. 1 is a partial perspective view of an end of a construction beam according to the present invention.
Figure 2:
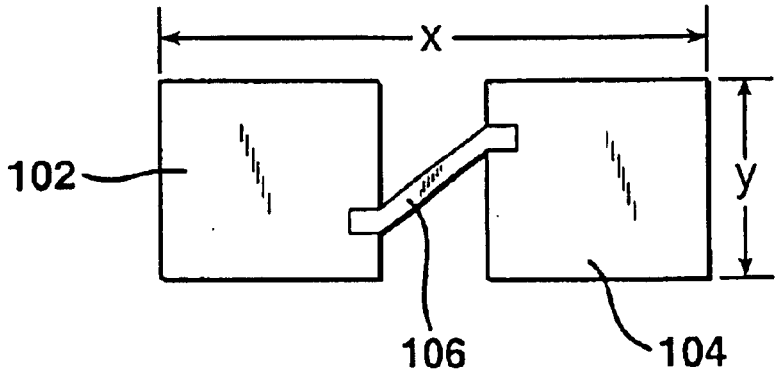
FIG. 2 is an end view of a beam according to the present invention.

FIGS. 1 and 2 illustrate a portion of a beam 100 according to the present invention. In general, beam 100 comprises lateral members 102 and 104 with a web 106 spanning therebetween.

Lateral members 102, 104 are generally rectangular or squared in cross-sectional profile and preferably have at least the same thickness y (see FIG. 2). Moreover, lateral beams 102, 104 are preferably identical so that each has the same width, proportionately spaced with web 106 therebetween so as to present an overall beam width x. Lateral members 102, 104 are preferably (but not necessarily) identical in shape so as to facilitate manufacture of beam 100 from one source of stock.

Accordingly, beam 100 can present a cross section having a major dimension x and minor dimension y corresponding to any standard beam size (e.g., 2"×4", 2"×6", and so on, without limitation).

According to the present invention, lateral members 102, 104 are elongate rigid members. Accordingly, a variety of suitably rigid materials could be used. However, lateral members 102, 104 are preferably (but not exclusively) made from wood, (in part, in keeping with an intent of the present invention to present a construction member very similar to those conventionally used in the art). Wood is also desirable because it can be worked, generally, in more ways than comparable metal members (e.g., it can be easily cut, driven with nails or screws, etc.). Not only can continuous lumber be used, but composite materials, such as plywood or wood particle board can be used. In addition, finger jointed wood members can be used according to the present invention. A plastic material reinforced with glass fibers may also be used in accordance with the present invention.

Web 106 is made from a relatively rigid material that has some flexibility. If web 106 is relatively too flexible, lateral members 102, 104 have too much relative freedom of movement and beam 100 is no longer, overall, a rigid member. If web 106 is relatively too stiff, then the benefits of sound isolation attenuation are lost. Generally, web 106 may be made from any suitably stiff and resilient material, including (without limitation) rubber, asphalt, plastic or other resilient polymeric material.

Figure 4:
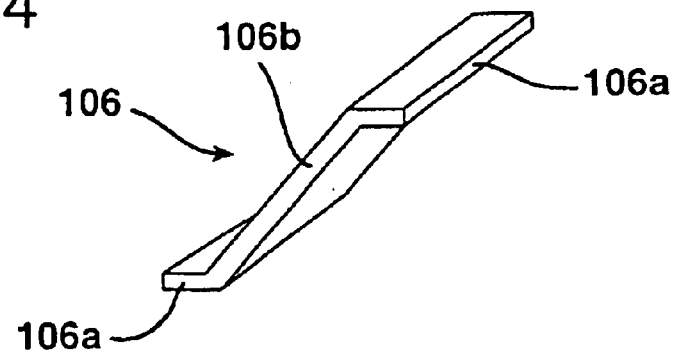
FIG. 4 is a perspective view of an example of a resilient web for linking lateral members in a beam according to the present invention.

In one example of the present invention, web 106 is made from galvanized 22 gauge steel. As seen in FIG. 4, web 106 includes edge portions 106*a* and an intermediate portion 106*b*. Edge portions 106*a* are embedded in lateral members 102, 104, and intermediate portion 106*b* extends obliquely between lateral members 102, 104. However, intermediate portion 106*b* may, most generally, extend between lateral members 102, 104 in any orientation so long as flexure between lateral members 102, 104 is relatively easy (compared to, for example, an intermediate portion extending straight across the gap between lateral members 102, 104, which does not readily flex).

It is noted that the use of galvanized steel as described here may offer additional ancillary benefits, such as improved fire safety protection.

Edge portions 106*a* are embedded in lateral members 102, 104 in any conventional manner. One possible method (not illustrated) is to form grooves in lateral members 102, 104 that are wider than the thickness of edge portions 106*a*. Once edge portions 106*a* are suitably disposed in the respective grooves, additional strips of material (such as wood) are pressed into the remaining space in the grooves, such that edge portions 106*a* are wedged into place and retained in the grooves.

Web 106 may extend continuously substantially the entire length of lateral members 102, 104. However, when beams 100 are used in construction, it is useful to provide a plurality of spaced apart webs 106, such that piping, wiring and the like can be passed through the openings between webs 106 (see FIG. 3).

Figure 3:
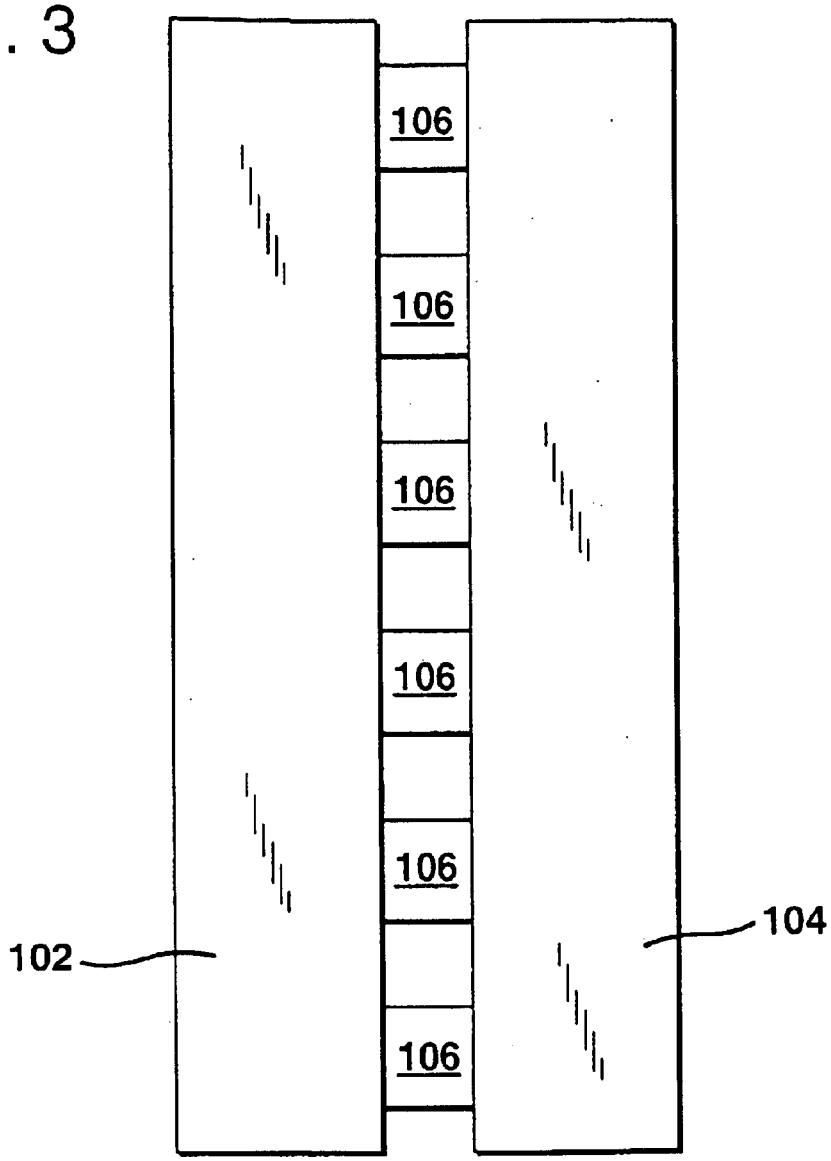
FIG. 3 is a plan view of a beam according to a second embodiment of the present invention.

Whether one or a plurality of webs 106 are provided, it is specifically contemplated that beams 100 are provided in standardized lengths (e.g., 8') as seen in FIG. 3 and can be cut down as required.

As mentioned above, it is an important feature of the present invention to provide a construction member that can be used like conventional construction beams. Accordingly, FIG. 5 is a partial perspective view of a frame work (as might be used for walls in a building).

Figure 5:
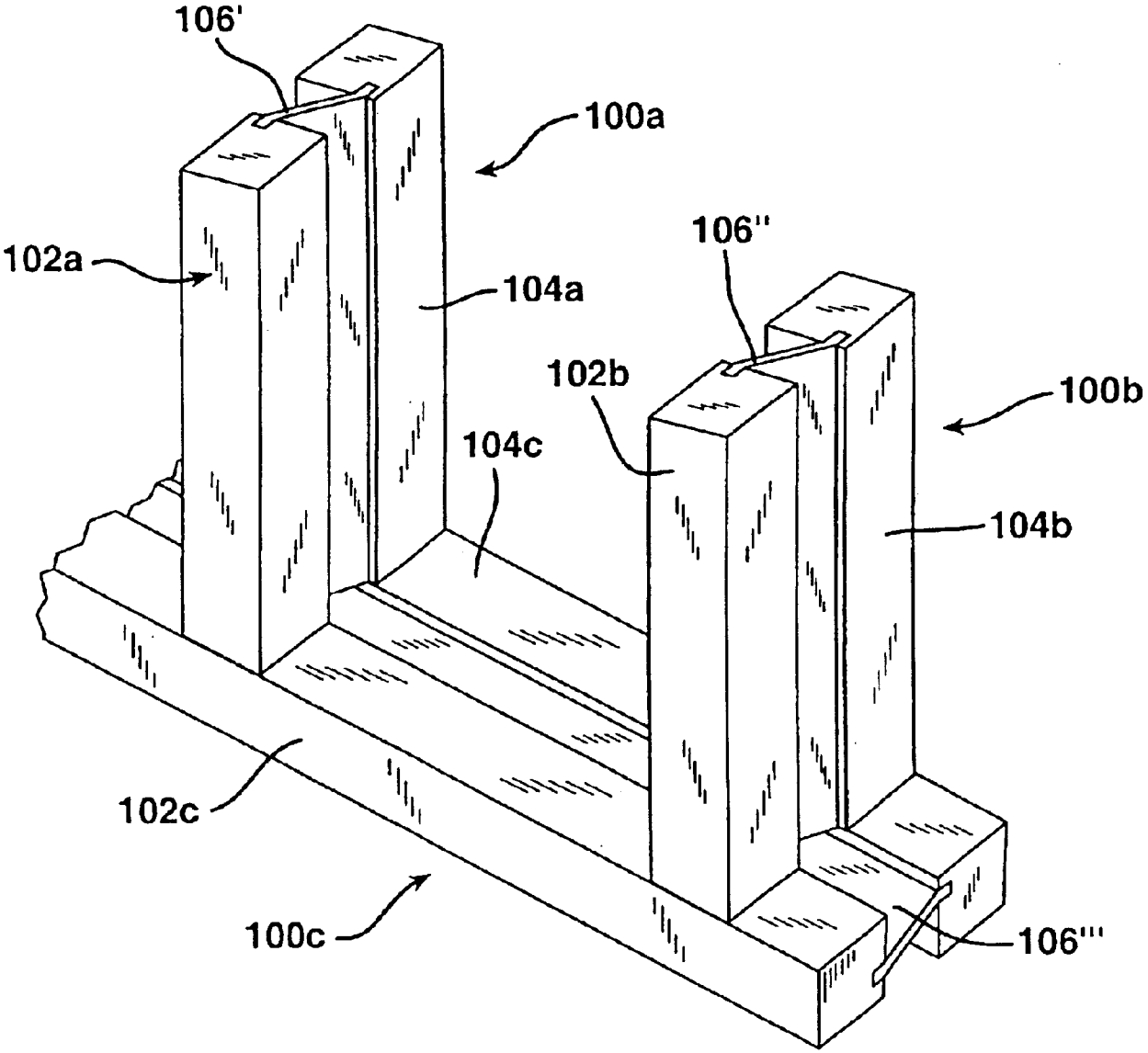
FIG. 5 is a perspective view of a framework for mounting wallboard or the like, utilizing beams according to the present invention.

As seen in FIG. 5, beams 100*a*, 100*b* are mounted as studs on a laterally extending beam (i.e., a head plate or toe plate) 100*c*. (Another laterally extending beam (not shown) is provided at the other end of beams 100*a*, 100*b*.) The structure of each of beams 100*a*–100*c* is in accordance with the description of the present invention hereinabove, and will not be repeated here. Attention is drawn to the manner in which lateral members 102*a* and 102*b* and 104*a* and 104*b* are mounted with respect to lateral members 102*c* and 104*c*, respectively, with nails, screws or any other conventional fasteners (not shown here). Accordingly, it can be appreciated that one side of the frame (i.e., lateral members 102*a*–102*c*) are resiliently separated by way of respective webs 106', 106", and 106'" from the other side of the frame (i.e., lateral members 104*a*–104*c*). Accordingly, sound impinging on a wall member mounted on one side of the frame is attenuated upon transmission to the other side of the frame because of the resilience of webs 106', 106", and 106'".

Furthermore, it is possible to resiliently mount a wall so that it acts like a diaphragmatic sound absorber. In particular, only one "side" of the frame assembly (e.g., lateral member 104*c* and/or lateral members 104*a*, 104*b*) is fixed to the surrounding building structure, and the other side of the frame assembly has wall board or the like mounted thereon (i.e., on lateral members 102*a*, 102*b*), without attachment to the surrounding structure. The wall is therefore mounted on the "free" or "floating" side of the studs.

A particularly beneficial wall board structure is disclosed in co-pending application Ser. No. 09/260,272, and comprises generally first and second dry wall layers with a visco-elastic material layer interposed therebetween. In paticular, a visco-elastic asphalt material is useful with such a wall board structure.

To further enhance the effect of decoupling the wall from the surrounding structure, it is preferable to provide flexible joint material at junctions between wall board segments (not illustrated here), including at corners of rooms. Therefore the wall surface is visually continuous, but physically decoupled, in order to take advantage of the resultant sound attenuation effects.

Also, it is very desirable to provide additional sound and/or thermal insulation in the spaces defined by the studs and end plates. Such insulation can be of any conventional type, including blown, rolled or batting, foam board, etc. The addition of such insulation enhances sound attenuation effects resulting from the present invention.

Figure 6:
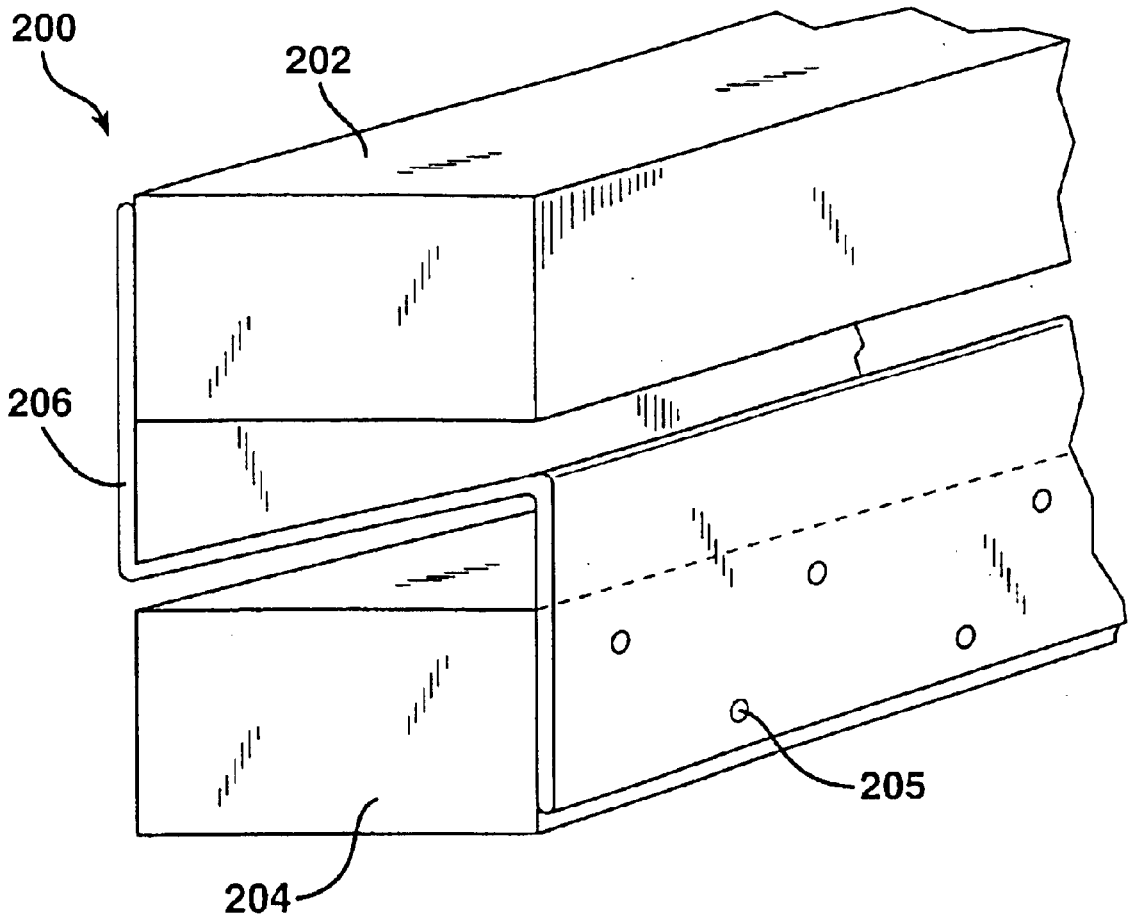
FIG. 6 is partial respective view of a beam according to a third embodiment of the present invention.
Figure 7:
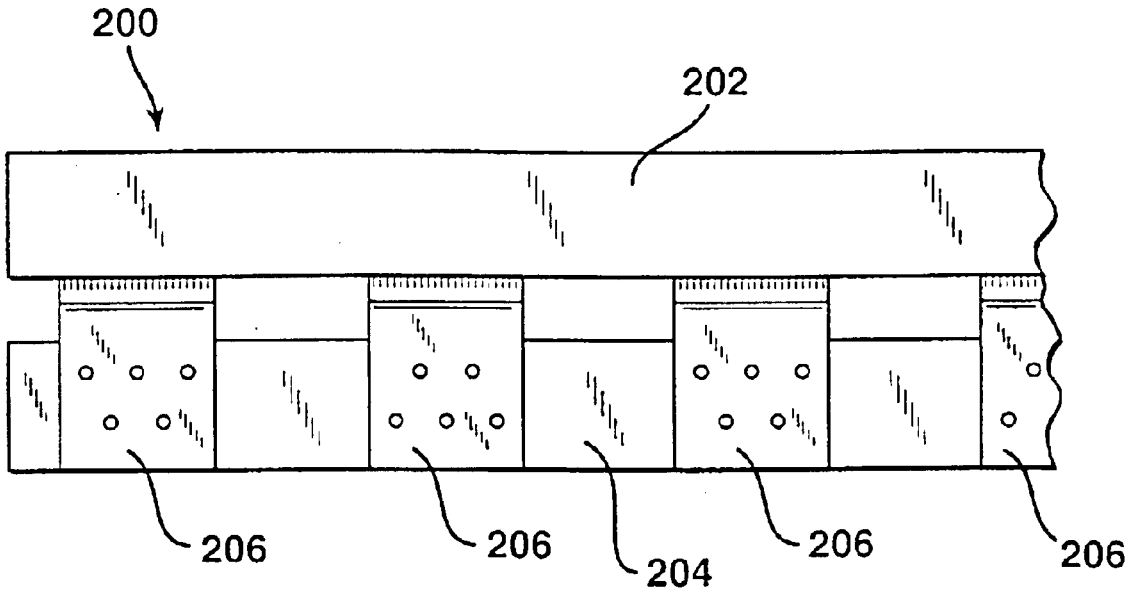
FIG. 7 is a plan view of a beam according to the embodiment of the present invention shown in FIG. 6.

FIGS. 6 and 7 are a partial perspective view and a partial plan view, respectively, of beam 200, in accordance with another embodiment of the present invention.

The design concept underlying beam 200 is fundamentally similar to that of beam 100. Like before, lateral members 202 and 204 are provided, and are resiliently spaced apart from each other by web 206. Unlike web 106 in beam 100, however, web 206 is not embedded in lateral members 202, 204. Instead, web 206 is fixed (by any conventional means, such as nails 205, as shown in FIGS. 6 and 7) relative to opposite faces of lateral members 202, 204 along the major dimension of the beam cross section.

As in the first embodiment, a plurality of spaced apart webs 206 may be provided along the length of beam 200 (see, for example, FIG. 7).

Web 206 is preferably made from a material that is slightly more flexible than that used for web 106, such as 24 gauge galvanized steel.

Initial comparative testing has been undertaken comparing the sound attenuation characteristics of conventional construction members versus beam 100 and beam 200, respectively. Initial results indicate that beam 100 has greater than expected attenuation characteristics, and that beam 200 should have even better attenuation performance than beam 100. This latter effect is thought to be caused by the shape and orientation of web 206, which more easily permits a normal compression between lateral members 202, 204.

Figure 8:
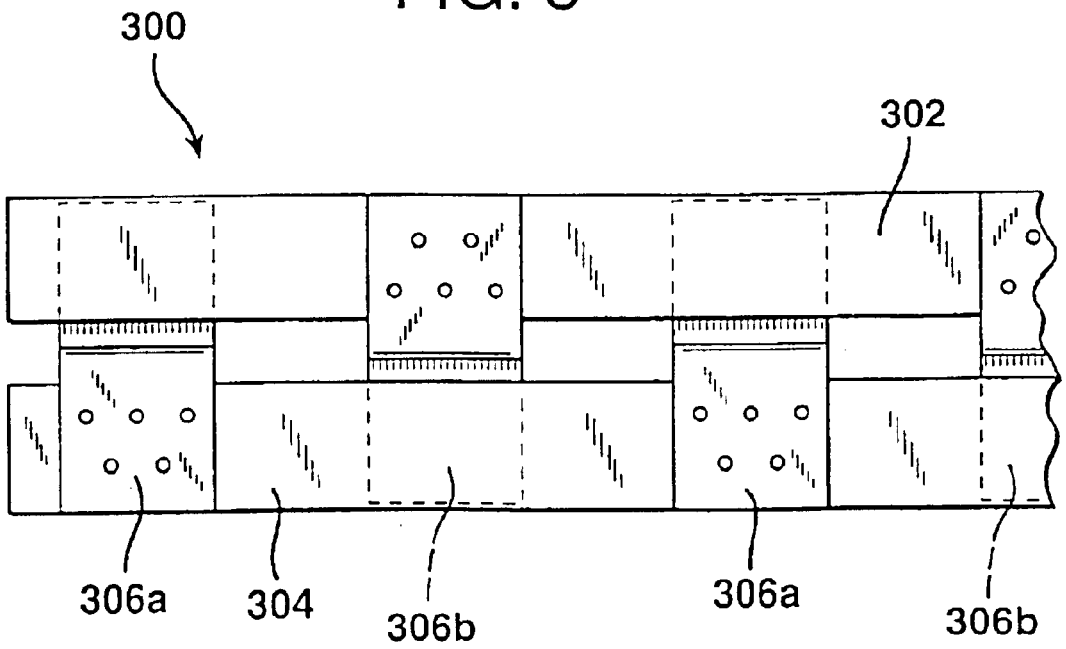
FIG. 8 is a plan view of a variant of the beam shown in FIG. 7.

In addition, as a variation of the embodiment illustrated in FIG. 7, the plurality of webs are alternately arranged so that the portion of the webs extending obliquely thereacross alternates (thereby crossing each other, as seen from an end of beam 200) (see FIG. 8). In FIG. 8, beam 300 comprises lateral beams 302 and 304, and includes a plurality of first webs 306*a* which are spaced from and alternate with a plurality of second webs 306*b*. Accordingly, respective intermediate portions of webs 306*a* and 306*b* crisscross as seen from an end of beam 300.

Inasmuch as sound that one seeks to attenuate or isolate is typically physically unique relative to particular environments (e.g., a home theater room, a movie theater, a machine shop, a recording studio, a concert hall), it is an important feature of the present invention to provide a construction member that can be "tuned" in order to tailor its sound attenuation properties for a specific environment. In other words, a beam according to the present invention can be specifically manufactured so that its resilient properties (in terms of, for example, spring constant) are made to correspond to a particular kind of sound (especially in terms of its frequency) so that sound attenuation can be maximized.

Such "tuning" can be accomplished by varying the thickness of web 106, 206, either uniformly or variably over the entire area of web 106, 206. In addition, notches, slits, or other openings can be formed in web 106, 206 to control the resilience of web 106, 206 in accordance with known principles of physics. In addition, suitably sized perforations or openings in a continuous web can be formed so as to create a tunable Helmholtz resonator effect between adjacent cavities defined between studs in the framework illustrated in FIG. 5. By altering the number and/or size of the perforations or openings, a resultant Helmholtz resonant frequency can be controlled, at which attenuation of sound at that frequency is maximized. It should be noted that this is different from reference to a plurality of webs as shown in FIGS. 3, 7, and 8.

It can therefore be appreciated that adjoining rooms may be constructed (e.g., adjoining musical studios) such that each room can be tuned in accordance with its respective mode of use. In particular, this may be accomplished by constructed "double wall" framework, where two frames of the structure illustrated in FIG. 5 are constructed face-to-face, such that the respective opposing sides of the frames are fixed to the surrounding building structure and their respective opposite sides are left free floating in the manner discussed above.

Assembly of lateral members and resilient webs according to the present invention is facilitated by providing at least one spacer on the resilient web or webs to orient the lateral members relative to the resilient web.

Figure 10:
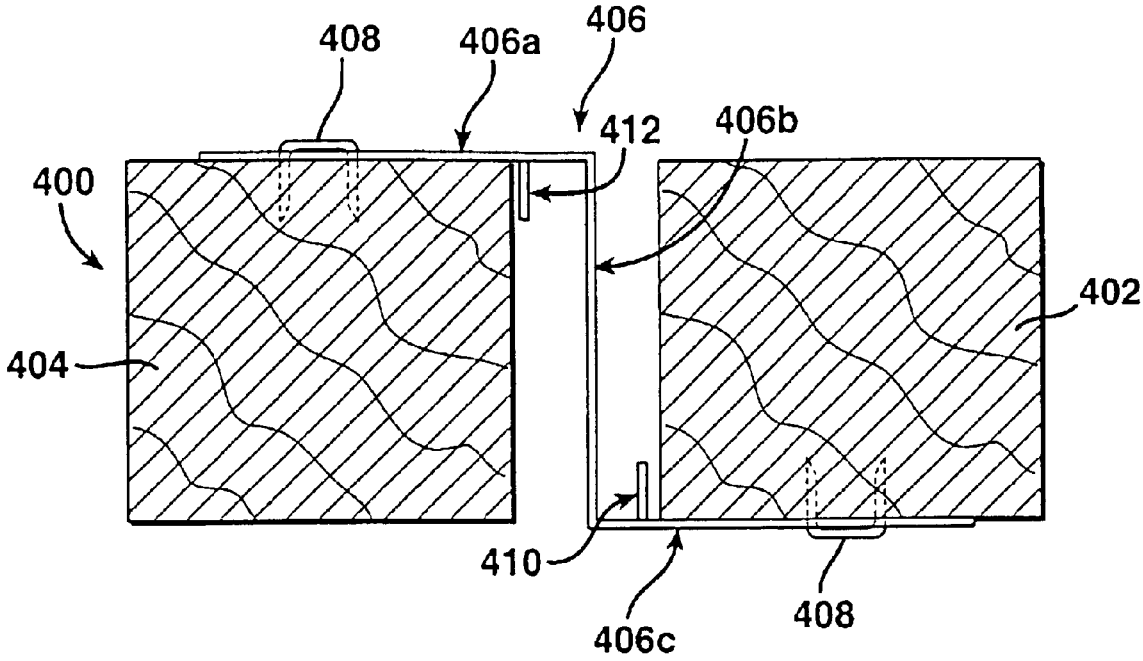
FIG. 10 is a cross-sectional view of a construction member according to a fifth embodiment of the present invention shown in FIG. 9.

FIG. 10 is a schematic cross-sectional view of a beam 400, somewhat similar to beams 200 and 300 in FIGS. 6–8. Here again, beam 400 comprises lateral members 402 and 404, and a resilient web 406 extending therebetween.

Resilient web 406 is attached to opposite facing sides of lateral members 402 and 404, respectively, by, for example, staples 408 (although any conventional attachment method can be used, including, without limitation, screws, nails, bolts, and the like).

Resilient web includes a first portion 406*a*, a second portion 406*b* bent at an angle to first portion 406*a*, and a third portion 406*c* bent at an angle to second portion 406*b* and generally parallel with first portion 406*a*. Generally, lateral members 402 and 404 are received in the bends defined by the first and second portions 406*a* and 406*b*, and by the second and third portions 406*b* and 406*c*, as shown in FIG. 10.

It is a particular feature of this embodiment to provide a spacer 410 (412) on at least one of first and third portions 406*a* and 406*c* to space a respective at least one of the lateral members 402 and 404 away from second portion 406*b* of the resilient web 406. In general, the provision of spacers 410 (412) allows easy assembly of the lateral members and the resilient web (known in the art as "self-jigging"). In particular, the provision of spacers 410, 412 prevents the respective lateral members 402, 404 from being placed in abutting relation to second portion 406*b*. If such an arrangement were to be had, then the abutment of the resilient members against the second portion 406*b* would undesirably retard the resilient sound-damping characteristics of the resilient web 406.

It is noted that the slight spacing shown in FIG. 10 between lateral members 402 and 404 and the resilient web 406 is for clarity of illustration only and is not illustrative of the present invention.

The arrangement of the present invention illustrated in FIG. 10 can be extended desirably to an apparatus and method for retrofitting standard beam members, especially beam members already assembled into a standard frame arrangement.

Figure 9:
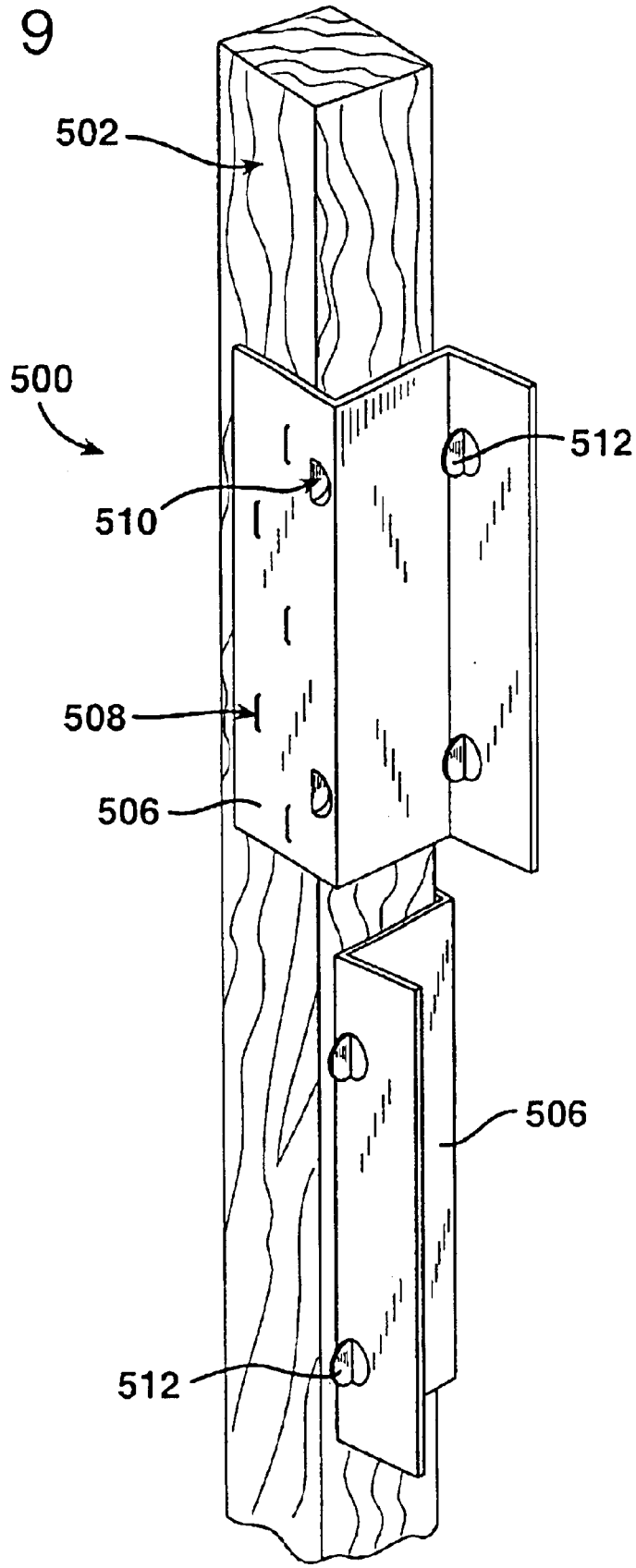
FIG. 9 is a perspective view of a retrofit assembly including a lateral member and a web, according to a fourth embodiment of the present invention.

FIG. 9 illustrates a retrofitting assembly 500 comprising a lateral beam 502, to which at least one resilient web 506 is attached by staples 508 or the like. Each resilient web 506 as shown includes spacers 510 and 512. However, the provision of spacers 512 is most important here. It is emphasized that assembly 500 in and of itself is not a construction member per se, but is used in conjunction with standard beams in order to provide a resilient beam arrangement.

As before, resilient web 506 may be made from any suitably resilient material, including (without limitation) metal, rubber, asphalt, plastic, or other resilient polymeric material. In one example, spacers 510, 512 are protruding tabs formed integrally with the resilient web 506. In a specific example, spacers 510, 512 may be punch-formed into the material of the resilient web 506 (especially, but not necessarily only, where the resilient web 506 is made from metal). The punch-formed portions can simply be turned away from the web material as needed to form the required spacers.

In the arrangement illustrated in FIG. 9, it is especially important to provide spacers 512 as shown. The assembly 500 is arranged relative to a single standard beam such as a 2"×4" (not shown here) and fastened thereto (again, by staples, screws, nails, bolts, or any known and suitable fastener). The arrangement of the assembly 500 relative to a standard beam is made simple by the provision of spacers 512, especially where assembly 500 is coupled to a standard beam forming part of a conventional framework.

In addition, the resilient webs 506 may be provided in an alternating arrangement, so that opposite sides of lateral member 502 are attached to respective resilient webs 506, as seen in FIG. 9 (this is similar to the arrangement illustrated in FIG. 8 and discussed above). With this arrangement, the assembly 500 may be even more easily arranged relative to a standard beam by orienting the assembly 500 so that respective free ends of the resilient webs 506 are arranged on opposite sides of the standard beam. Although the alternating arrangement of resilient webs 506 seen in FIG. 9 is beneficial (for reasons similar to those discussed above relative to FIG. 8), it is not necessary according to the present invention. The present invention is certainly operable with the resilient webs 506 all arranged in like manner along lateral member 502.

As with the other embodiments discussed above, lateral member 502 may be rectangular or squared in cross-section, and may preferably be made from continuous lumber or a composite wood material, as well as plastic reinforced with glass fibers.

In one example of the present invention, the spacers 410, 412, 510, 512 may be arranged to space the respective lateral members about 0.25 inches from the portion of the resilient web spanning the space between the lateral members. However, the present invention is not restricted to a specific spacing, except for that sufficient to prevent the respective lateral members from fully abutting the resilient web, as discussed above.

One of ordinary skill will appreciate that the resilient web 506 may be shaped so as to be attached to lateral members of different profiles. In one example, a lateral member 502 which is rectangular or squared in cross-section attached to the resilient web 506 may be used so as to be attached to a conventional rigid I-beam (discussed above relative to the related art) or vice versa.

It will be appreciated that the assembly 500 as seen in FIG. 9 can been seen as somewhat analogous to a conventional resilient channel. However, at least because of the self-jigging aspect of the assembly 500 (due to the provision of spacers), the assembly 500 is much easier to work with compared with resilient channel structures.

Although construction members according to the present invention have been described hereinabove for wall frames and the like, they are also contemplated for use in mounting floating ceilings which are acoustically isolated from a building structure. In addition, construction members according to the present invention may also be used in floor construction.

In particular, a construction member for mounting a floating ceiling may be used by fixing one of the lateral members to the building structure and fixing a ceiling member to the free floating lateral member (i.e., the lateral member not fixed to the building structure).

The use of substantially identical lateral members is contemplated according to the present invention. However, use of dissimilar lateral members is also expressly within the scope of the present invention. For example, one of the lateral members 102, 104 shown in FIG. 2 may be replaced by a conventional wood I-beam of the type described above. In particular, web 106 may be embedded in one of the flange portions of the wood I-beam, in the manner disclosed above.

Although the present invention is directed primarily to construction members made from non-metal materials, the design concepts may be of interest in the manufacture of metal studs comprising a pair of metal members with a resilient web extending therebetween in accordance with the foregoing description. In particular, a metal stud using the inventive principles disclosed herein could be made from a single piece of sheet metal, formed into shape.

The present invention being thusly described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A beam member comprising:

a plurality of spaced apart lateral members; and a resilient sound dampening web including a first edge portion, a second edge portion and an intermediate portion wherein said first and second edge portions are fixed to respective ones of said lateral members, wherein said intermediate portion extends between said lateral members to form a generally S-shaped structure and permits flexure between said lateral members, wherein said resilient sound dampening web includes at least one a spacer arranged on at least one of said first or second edge portions to space at least one of said lateral members away from said intermediate portion of said resilient web.

2. The beam member according to claim 1, wherein said lateral members are squared in cross-section.

3. The beam member according to claim 1, wherein said web is made from metal.

4. The beam member according to claim 3, wherein said web is made from galvanized steel.

5. The beam member according to claim 3, wherein said web is made from 26 gauge stock or thinner.

6. The beam member according to claim 4, wherein said web is made from 26 gauge stock or thinner.

7. The beam member according to claim 1, wherein said plurality of lateral members are made from wood.

8. The beam member according to claim 1, wherein said plurality of lateral members are made from wood particle board.

9. The beam member according to claim 7, wherein said lateral members are made from finger jointed wood segments.

10. The beam member according to claim 1, wherein said lateral members are made from a plastic material reinforced with glass fibers.

11. The beam member according to claim 1, wherein said resilient web is made from a resilient polymeric material.

12. The beam member according to claim 1, wherein said first and second edge portions of said web are fixed to said respective pairs of lateral members using at least one of screws, nails, staples, and bolts.

13. The beam member according to claim 1, comprising a plurality of spaced apart said webs extending between said respective pairs of said lateral members.

14. The beam member according to claim 13, wherein said plurality of spaced apart webs are arranged in an alternating orientation relative to said respective pairs of lateral members so as to criss-cross in cross section.

15. The beam member according to claim 1, comprising two said spaced apart lateral members with said resilient web extending therebetween.

* * * * *

UNITED STATES PATENT AND TRADEMARK OFFICE

CERTIFICATE OF CORRECTION

PATENT NO. : 6,711,867 B1
DATED : March 30, 2004
INVENTOR(S) : Smith

It is certified that error appears in the above-identified patent and that said Letters Patent is hereby corrected as shown below:

Title page,
Item [75], Inventors, add the following inventors:

-- Frank C. O'Brien-Bernini
Ralph D. McGrath --

Signed and Sealed this

Twenty-fifth Day of May, 2004

JON W. DUDAS
*Acting Director of the United States Patent and Trademark Office*